US006375294B1

(12) United States Patent
Kneezel

(10) Patent No.: US 6,375,294 B1
(45) Date of Patent: Apr. 23, 2002

(54) GRAY SCALE FLUID EJECTION SYSTEM WITH OFFSET GRID PATTERNS OF DIFFERENT SIZE SPOTS

(75) Inventor: Gary Alan Kneezel, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/723,238

(22) Filed: Nov. 28, 2000

(51) Int. Cl.[7] ..... B41J 29/38; B41J 2/205; B41J 2/145; B41J 2/21

(52) U.S. Cl. ..... 347/9; 347/15; 347/41; 347/43

(58) Field of Search ..... 347/9, 15, 41, 347/43

(56) References Cited

U.S. PATENT DOCUMENTS 5,192,959 A 3/1993 Drake et al. ..... 347/42
5,598,191 A 1/1997 Kneezel ..... 347/40
5,745,131 A 4/1998 Kneezel et al. ..... 347/15
6,145,960 A * 11/2000 Kanda et al. ..... 347/41

OTHER PUBLICATIONS

U.S. application Ser. No. 09/233,110 filed Jan. 19, 1999.

* cited by examiner

*Primary Examiner*—John Barlow
*Assistant Examiner*—Alfred E Dudding
(74) *Attorney, Agent, or Firm*—Oliff & Berridge, PLC

(57) ABSTRACT

A fluid ejection system and method for variable density pattern forming by producing a plurality of large, mid-sized and small spots. The plurality of large, mid-sized and small spots are produced by a plurality of large, mid-sized and small nozzles, each having a predetermined nozzle diameter. Furthermore, the plurality of large, mid-sized and small spots are placed on different grids, where the grid spacing for at least one of the pluralities of smaller spots is less than the grid spacing of the plurality large spots and is offset from it. The sizes, selection and spacing of the spots are designed to provide a substantially uniformly increasing area coverage from no coverage all the way to full coverage.

22 Claims, 16 Drawing Sheets

GRAY SCALE FLUID EJECTION SYSTEM WITH OFFSET GRID PATTERNS OF DIFFERENT SIZE SPOTS

BACKGROUND OF THE INVENTION

1. Field of Invention

This invention relates generally to a liquid ink printing apparatus and a method for gray scale printing using different size drop ejectors.

2. Description of Related Art

Fluid ejector systems, such as drop-on-demand liquid ink printers, such as piezoelectric, acoustic, phase change wax-based or thermal, have at least one fluid ejector from which droplets of fluid are ejected towards a receiving sheet. Within the fluid ejector, the fluid is contained in a plurality of channels. Power pulses cause the droplets of fluid to be expelled as required from orifices or nozzles at the end of the channels.

In a thermal fluid ejection system, the power pulse is usually produced by a heater transducer or resistor, typically associated with one of the channels. Each resistor is individually addressable to heat and vaporize fluid in one of the channels. As voltage is applied across a selected heater resistor, a vapor bubble grows in the associated channel and initially bulges from the channel orifice followed by a collapse of the bubble. The fluid within the channel then retracts and separates from the bulging fluid to form a fluid droplet moving in a direction away from the channel orifice and towards the recording medium. When the fluid droplet hits the receiving medium, the fluid droplet forms a dot or spot of fluid on the receiving medium. The channel is then refilled by capillary action, which, in turn, draws fluid from a supply container of fluid.

A fluid ejector can include one or more thermal fluid ejector dies having a heater portion and a channel portion. The channel portion includes an array of fluid channels that bring fluid into contact with the resistive heaters, which are correspondingly arranged on the heater portion. In addition, the heater portion may also have integrated addressing electronics and driver transistors. Since the array of channels in a single die assembly is not sufficient to cover the length of a page, the fluid ejector is either scanned across the page with the receiving medium advanced between scans or multiple die assemblies are butted together to produce a full-width fluid ejector.

Because thermal fluid ejector nozzles typically produce spots or dots of a single size, high quality fluid ejection requires the fluid channels and corresponding heaters to be fabricated at a high resolution, such as, for example, on the order of 400–600 or more channels per inch.

When the fluid ejector is an ink jet printhead, the fluid ejector may be incorporated into for example, a carriage-type printer, a partial width array-type printer, or a page-width type printer. The carriage-type printer typically has a relatively small fluid ejector containing the ink channels and nozzles. The fluid ejector can be sealingly attached to a disposable fluid supply cartridge. The combined fluid ejector and cartridge assembly is attached to a carriage that is reciprocated to print one swath of information at a time, on a stationary receiving medium, such as paper or a transparency, where each swath of information is equal to the length of a column of nozzles.

After the swath is printed, the receiving medium is stepped a distance at most equal to the height of the printed swath so that the next printed swath is contiguous or overlaps with the previously printed swath. This procedure is repeated until the entire image is printed.

In contrast, the page-width printer includes a stationary fluid ejector having a length sufficient to print across the width or length of the sheet of receiving medium. The receiving medium is continually moved past the page-width fluid ejector in a direction substantially normal to the fluid ejector length and at a constant or varying speed during the printing process. A page width fluid ejector printer is described, for instance, in U.S. Pat. No. 5,192,959, incorporated herein by reference in its entirety.

Fluid ejection systems typically eject fluid drops based on information received from an information output device, such as a personal computer. Typically, this received information is in the form of a raster, such as, for example a full page bitmap or in the form of an image written in a page description language. The raster includes a series of scan lines comprising bits representing individual information elements. Each scan line contains information sufficient to eject a single line of fluid droplets across the receiving medium a linear fashion. For example, fluid ejecting printers can print bitmap information as received or can print an image written in the page description language once it is converted to a bitmap of pixel information.

In a fluid ejection system having a fluid ejection with an array of equally sized and spaced nozzles, each of the equally sized nozzles produces fluid spots of the same size, and the pixels are placed on a square first grid having a size S. As shown on FIG. 1, the spacing between the centers 62 of the fluid spots in the X and Y direction is equal to S, as illustrated in a sample printing pattern shown in FIG. 1. To create the pattern shown in FIG. 1, nozzles 60, which are schematically represented as triangles, traverse across a receiving medium 69 in the scan direction X. The nozzles 60, which are spaced from one another a specified distance or pitch d on the fluid ejection, deposit the fluid spots or drops on the pixel centers 62. It should be appreciated that the grid spacing in the nozzle array direction Y is perpendicular to the scan direction. In general, to deposit the fluid spots on the receiving medium in a square grid, the pitch d is equal to the grid spacing S.

Typically, the nozzles 60 and the ejection parameters are designed to produce spot diameters of approximately 1.414S (i.e., $S\sqrt{2}$). This allows the space within an solid region of the pattern to be completely filled, by having diagonally adjacent spots touch. A disadvantage of this ejection scheme is that "jaggedness" may be objectionable at edges in the pattern, particularly for lines or curves at small angles to the scan direction as illustrated in FIG. 1. In FIG. 1, a first ellipse 64 located outside a second ellipse 66 indicate at what portions of the printed image the jaggedness would be most objectionable. In addition, pattern quality can be determined by 1) how much open space remains within the ring defined by the first and second ellipses 64 and 66, 2) how far the spots 60 extend outside either the first and/or second ellipses 64 and/or 66, and 3) the amount of fluid deposited on the receiving medium.

One technique for improving the edge quality of the pattern is to extend the addressability of the carriage to allow dot placement at intermediate positions in the grid along the scan direction X. It is also possible to improve edge quality of the pattern by increasing the resolution. This, however, increases the complexity and cost of fabrication and typically slows down forming the pattern because of the additional number of spots to be ejected.

The fluid ejection and ejection methods discussed above and illustrated in FIG. 1, for example, provide for forming patterns of ejected fluid drops having sufficient quality, especially when the resolution is increased upwards to and beyond 600 spots per inch. These fluid ejectors and methods, however, do not always provide patterns having the desired quality especially when considering fluid density levels, fluid saving modes, and patterns forming throughput.

SUMMARY OF THE INVENTION

A majority of thermal fluid ejection systems produce spots or drops of fluid all having substantially the same diameter, and allow spot size to be controllably varied by at most approximately 10%. Therefore, these conventional fluid ejection systems are not capable of forming a pattern using variable fluid density regions. In thermal fluid ejection systems, for example, drop volume or spot size is determined by many factors, including the heater transducer area, the cross-sectional area of the fluid ejecting channel or nozzle, the pulsing conditions necessary to create a fluid droplet and the physical properties of the fluid itself, such as the temperature of the fluid in the channels. Although spot diameter changes of approximately ±10 percent are possible by changing pulsing conditions or fluid temperature during forming the pattern, the given spot size is nominally constant to the extent that deliberate spot size variations cannot span a large enough range to be useful in forming patterns having a variable fluid density.

Another technique for improving pattern forming quality, especially variable density pattern forming quality, uses groups of differently-sized nozzles with a major grid of large spots offset diagonally by 0.5S in the X and Y direction from a minor grid of small spots, where S is the grid spacing. This technique is disclosed in detail in U.S. Pat. No. 5,745,131 to Kneezel et al., incorporated herein by reference in its entirety.

FIG. 2 illustrates a pattern according to the 131 patent, where the pattern is formed with a fluid ejector having a first plurality of nozzles 67 and a second plurality of nozzles 68. The pitch between the individual nozzles 67 is equal to the distance S. The spacing between individual nozzles 68 is also equal to the distance S. However, the first plurality of nozzles 67 is offset from the second plurality of nozzles 68 by 1.5S.

The fluid ejection system fires the individual nozzles 67 and 68 so that the fluid drops land on the grid points 67*a* and 68*a*, respectively, in the scan direction. A somewhat better fill is achieved by this techniques compared to the pattern illustrated in FIG. 1, at least in terms of the amount of fluid used. Since the number of nozzles within each of the first plurality of nozzles 67 and the second plurality of nozzles 68 are equivalent, the receiving medium is advanced half the fluid ejection length to achieve proper fill.

Another technique for improving printing quality is disclosed in U.S. Pat. No. 5,598,191 to Kneezel, incorporated herein by reference in its entirety. The 191 patent describes a printhead having first and second linear arrays of ejectors. These ejectors are spaced within each array by a predetermined pitch. The arrays spaced from each other by an integral number of pitches plus a partial pitch. This allows interleaving of print swaths by the two sets of ejectors, in order to print at higher resolution than the predetermined pitch would allow.

Another technique for improving pattern forming quality, especially variable density pattern forming quality, is disclosed in pending U.S. patent application Ser. No. 09/233,110 to Kneezel et al., incorporated herein by reference in its entirety. The 110 application discloses that the optimum spot diameters to reduce the amount of fluid used for the printing pattern shown in FIG. 2 includes a first plurality of nozzles that produce a first spot of fluid having a diameter of $1.25^{0.5}$ S (=1.12S), and a second plurality of nozzles that produce a second spot of fluid having a diameter of 0.5S. In this case, only 75% of the fluid is required relative to the printing pattern where all of the spots have the same diameter of 1.414S. The 110 application also discloses an alternative printhead configuration which may be used to print the pattern shown in FIG. 2. In this alternative configuration, the nozzles of the first plurality of nozzles are interleaved with the nozzles of the second plurality of nozzles, where the nozzles of each array are spaced at a pitch of S, and the arrays are offset relative to each other at 0.5S. To provide the offset along the scan direction X, the nozzles of the first plurality of nozzles are fired first, followed by the nozzles of the second plurality of nozzles.

The 131 patent also describes a configuration that uses three different sized nozzles with three different offsets along the Y direction. A plurality of each differently-sized nozzle is provided. Spots printed by the pluralities of the two smaller-sized nozzles are offset from the spots printed by the plurality of the largest nozzles along the scan direction X by 0.5S.

This invention provides systems and methods for forming variable density patterns using multiple spots within the grid spacing using at least one of the array of smaller drop ejectors.

The invention separately provides at least some smaller spots which are not relatively offset from the major grid of spots in the Y direction.

In various exemplary embodiments of the systems and methods for variable density pattern forming according to this invention, variable density pattern forming is achieved by producing a plurality of large, medium and small spots. The plurality of large, medium and small spots are produced by a plurality of large, medium and small nozzles, each having a predetermined nozzle diameter.

Furthermore, the plurality of large, medium and small spots are placed on a grid. The grid has a spacing such that the desired amount of ink coverage is achieved. The grid is filled by sequentially ejecting a plurality of large, medium and small spots onto the grid.

In various exemplary embodiments of the systems and methods according to this invention, by appropriately selecting the drops sizes and relative grid spacing for the differently sized fluid drops, an increased number of density levels can be obtained. In various exemplary embodiments of the systems and methods according to this invention, the different density levels are on a generally smooth curve between the minimum and maximum density levels. In various exemplary embodiments, this substantially smooth curve is a substantially straight line.

These and other features and advantages of this invention are described and are apparent from the detailed description of various exemplary embodiments of the systems and methods according to this invention.

BRIEF DESCRIPTION OF THE DRAWINGS

Various exemplary embodiments of this invention will be described in detail with reference to the following figures, where like numerals represent like elements, and wherein.

DETAILED DESCRIPTION OF EXEMPLARY EMBODIMENTS

The following detailed description of various exemplary embodiments of the fluid ejection systems according to this invention are directed to one specific type of fluid ejection system, an ink jet printer, for sake of clarity and familiarity. However, it should be appreciated that the principles of this invention, as outlined and/or discussed below, can be equally applied to any known or later developed fluid ejection systems, beyond the ink jet printer specifically discussed herein.

Figure 1:
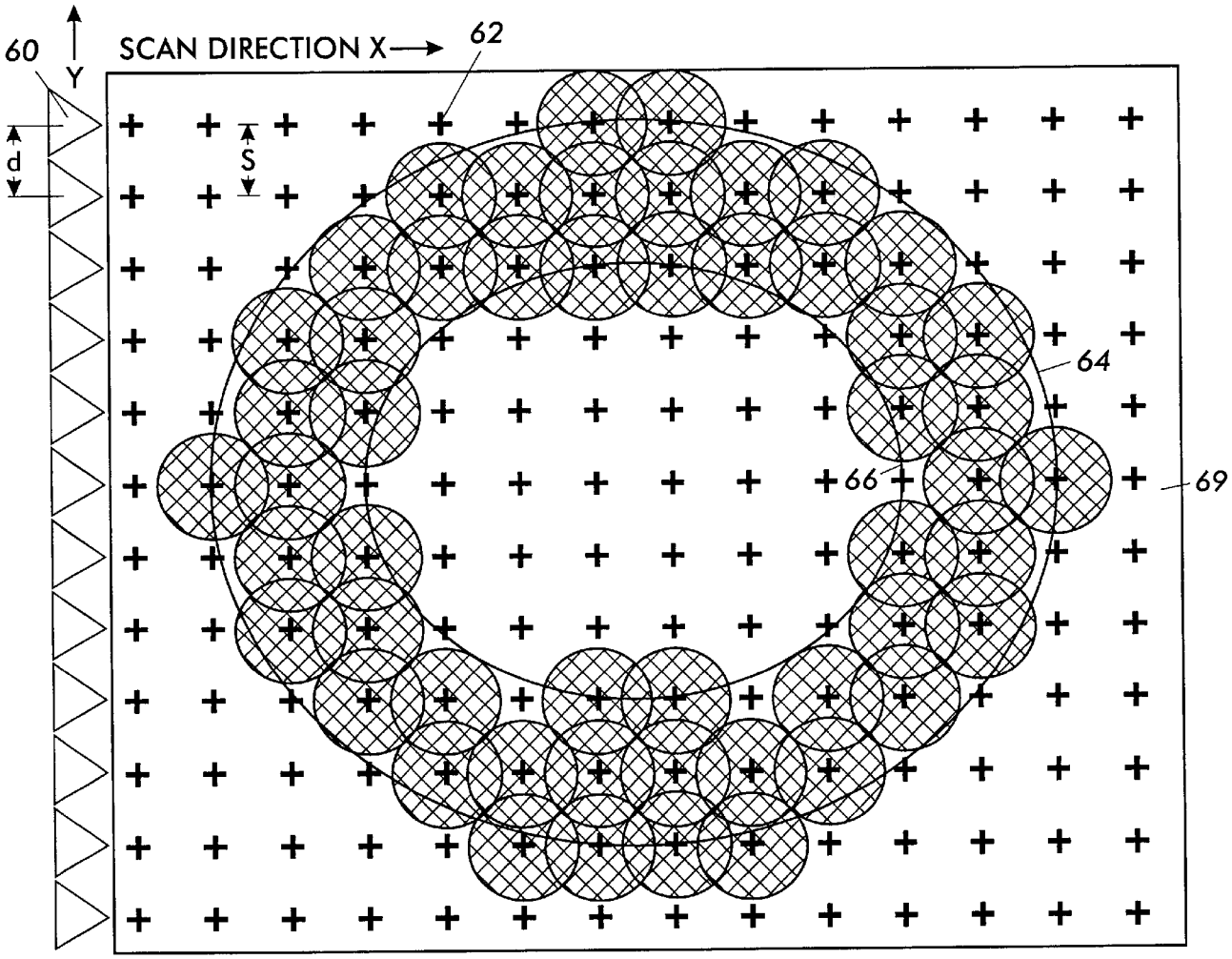
RELATED ART FIG. 1
FIG. 1 illustrates the location of ink spots in a pattern deposited by a printhead having ink ejecting nozzles of the same size.
Figure 2:
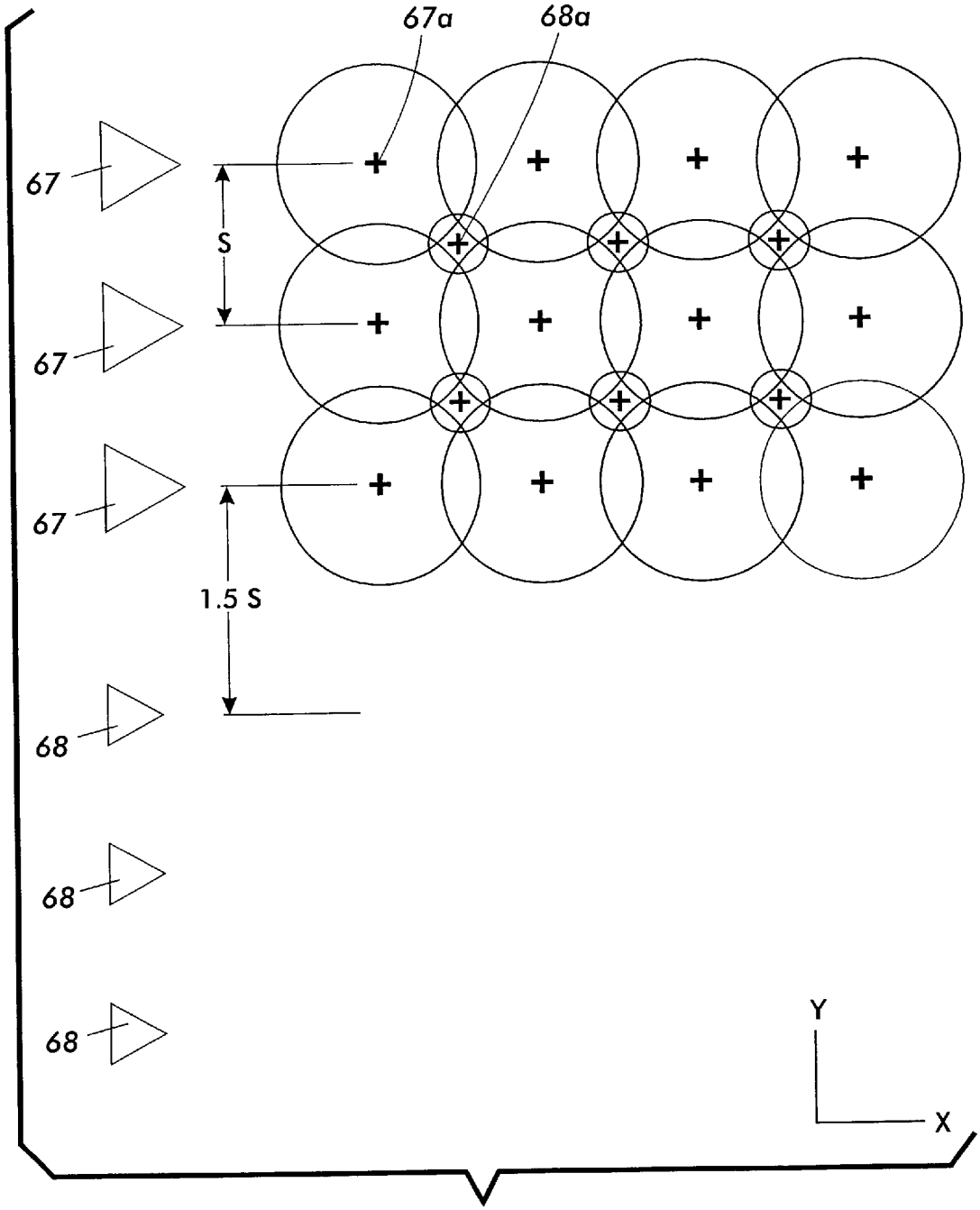
FIG. 2 illustrates the location of ink spots in a pattern deposited by a printhead having ink ejecting nozzles of two different sizes.
Figure 3:
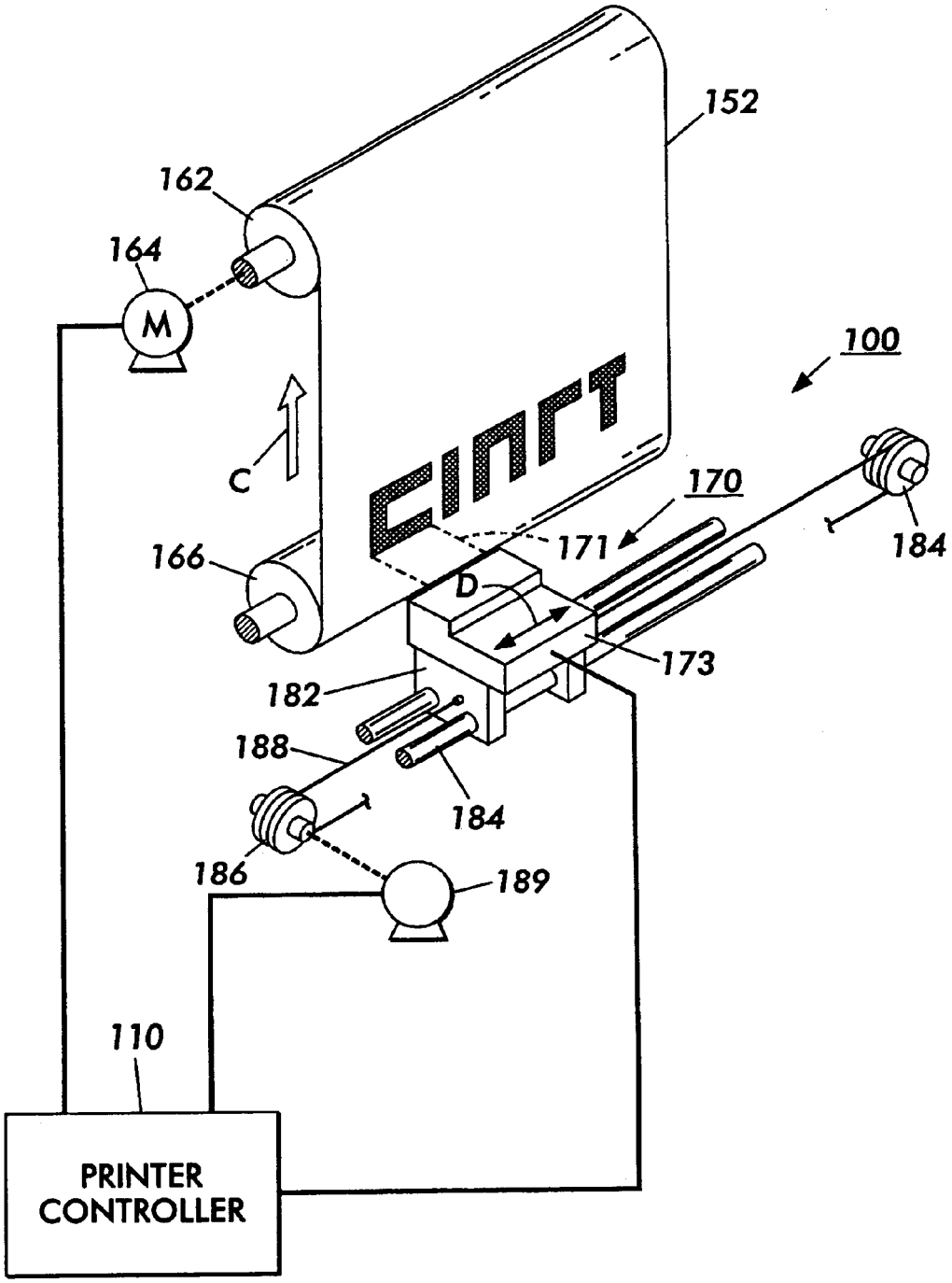
FIG. 3 is a schematic view of an ink jet printing system usable with ink jet printing systems and methods according to this invention.

FIG. 3 shows an exemplary carriage-type ink jet printing device 100. One or more linear arrays of droplet-producing channels is housed in one or more printheads 170 mounted on a reciprocal carriage assembly 173. The array extends along the paper advance direction C. In the exemplary carriage-type ink jet printing device 100 shown in FIG. 3, the one or more printheads 170 includes two or more nozzle arrays. Ink droplets 171 are propelled onto a receiving medium 152, such as a sheet of paper, that is stepped a preselected distance in the direction C, at most equal to the length of the array in the direction C, by a motor 164 each time the printhead 170 traverses across the recording medium 152 along the swath axis or fast scan direction. The receiving medium 152 can be a continuous sheet stored on a supply roll 166 and stepped onto takeup roll 162 by the stepper motor 164, or can be a continuous sheet or diskette sheets, and can be stored in and/or advanced using other structures, apparatuses or devices well known to those of skill in the art.

The one or more printheads 170 are fixedly mounted on a support base 182, which reciprocally moves along the fast scan direction D using any well known structure, apparatus or device, such as two parallel guide rails 184. A cable 188 and a pair of pulleys 186 can be used to reciprocally move one or more printheads 170 along the guide rails 184. One of the pulleys 186 can be powered by a reversible motor 189. The one or more printheads 170 are generally moved across the receiving medium 152 perpendicularly to the direction the receiving member 152 is moved by the motor 164. Of course, other structures for reciprocating the carriage assembly 173 are possible.

The ink jet printing device 100 is operated under the control of controller 110. The controller 110 transmits commands to the motors 164 and 189 and to the one or more printheads 170 to produce a pattern of ejected fluid drops, such as, for example, images on the receiving medium 152. Furthermore, the controller 110 can control the ejection of ink from the one or more printheads 170.

FIGS. 4–7 are exemplary embodiments of grid patterns of differently-sized spots created by a plurality of arrays of differently-sized nozzles. Three differently-sized spots created by three arrays of nozzles, each having different nozzles size, will be described below. However, it should be appreciated that more than three differently-sized spots can be produced to vary the available number of different density levels.

Figure 4:
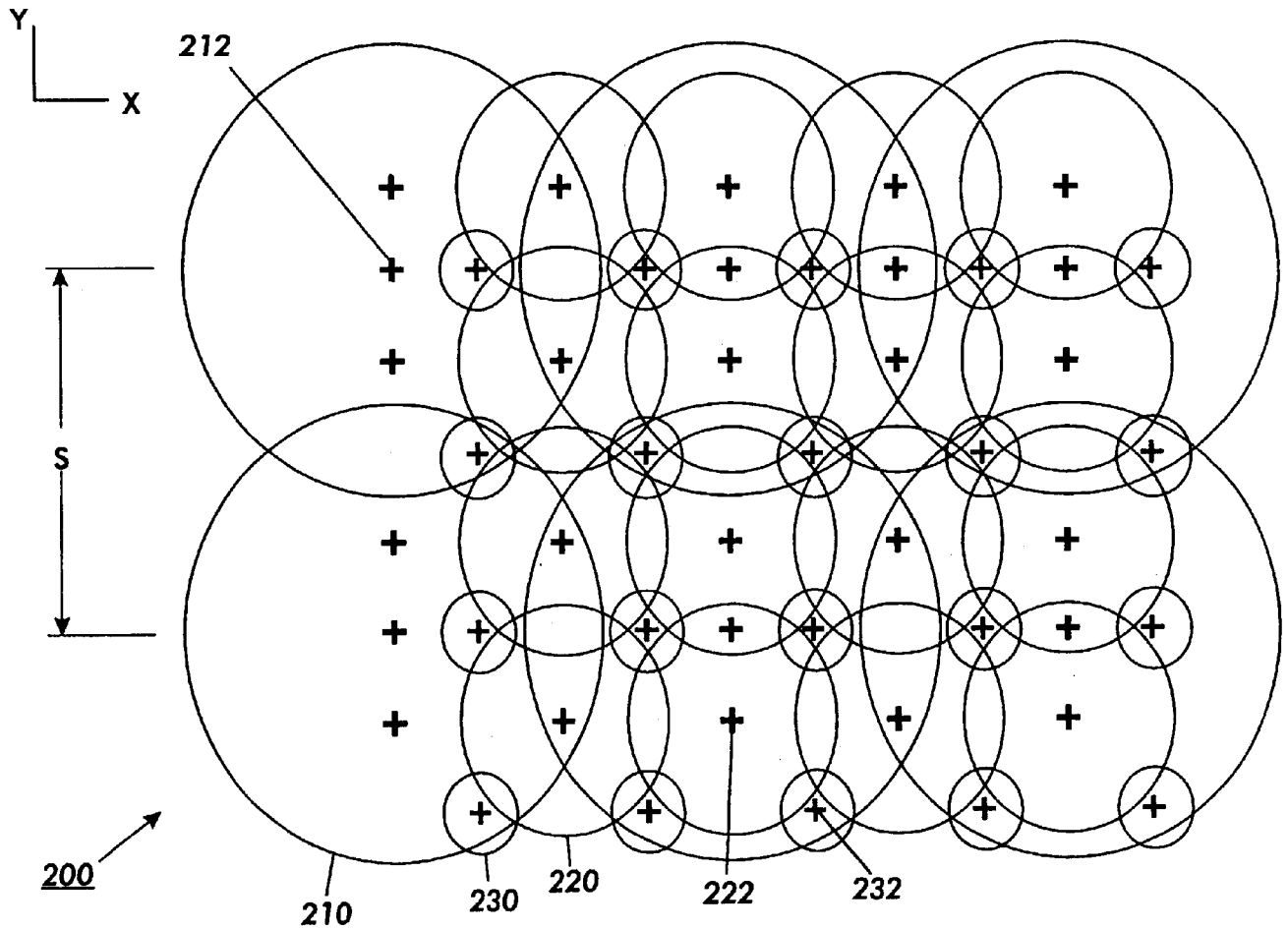
FIG. 4 is a first exemplary embodiment of a fluid ejection pattern that uses different offset grids for each differently-sized spot.

FIG. 4 shows a first exemplary embodiment of a pattern 200 of differently-sized spots created by the plurality of differently-sized nozzles according to this invention. The pattern shown in FIG. 4 includes a plurality of large spots 210. The centers 212 of these large spots 210 are spaced at a distance S in both the X and Y, fast scan and paper advance, directions. The pattern 200 also includes a plurality of mid-sized spots 220. The centers 222 of these mid-sized spots 220 are spaced at a distance S/2 along the X direction and offset along the Y direction from the centers 212 of the large spots 210 by S/4.

The pattern 200 also includes a plurality of small spots 230. The centers 232 of these small spots 230 are spaced at a distance of S/2 along the X and Y directions and are offset diagonally from the mid-sized spots 220 by S/2 in both the X and Y directions. It should be appreciated that some of the small spots 230 are aligned with the large spots 210 in the Y, or paper advance, direction, but are offset in the X, or scan, direction. It should also be appreciated that the mid-sized and small spots 220 and 230 are provided in the pattern 200 at twice the resolution as the large spots 210.

In various exemplary embodiments, the large spots 210 are printed at a frequency F, with both of the smaller sized spots 220 and 230 printed at a frequency of 2F. In various exemplary embodiments, the diameters of the differently-sized spots are approximately 1.2S, 0.6S and 0.2S for the large, mid-sized and small spots 210, 220 and 230, respectively. Thus, in these various exemplary embodiments, nearly 200% fluid coverage can be obtained. However, it should be appreciated that any set of spot diameters can be used in the patterns and the systems and methods according to this invention that use these patterns.

Figure 5:
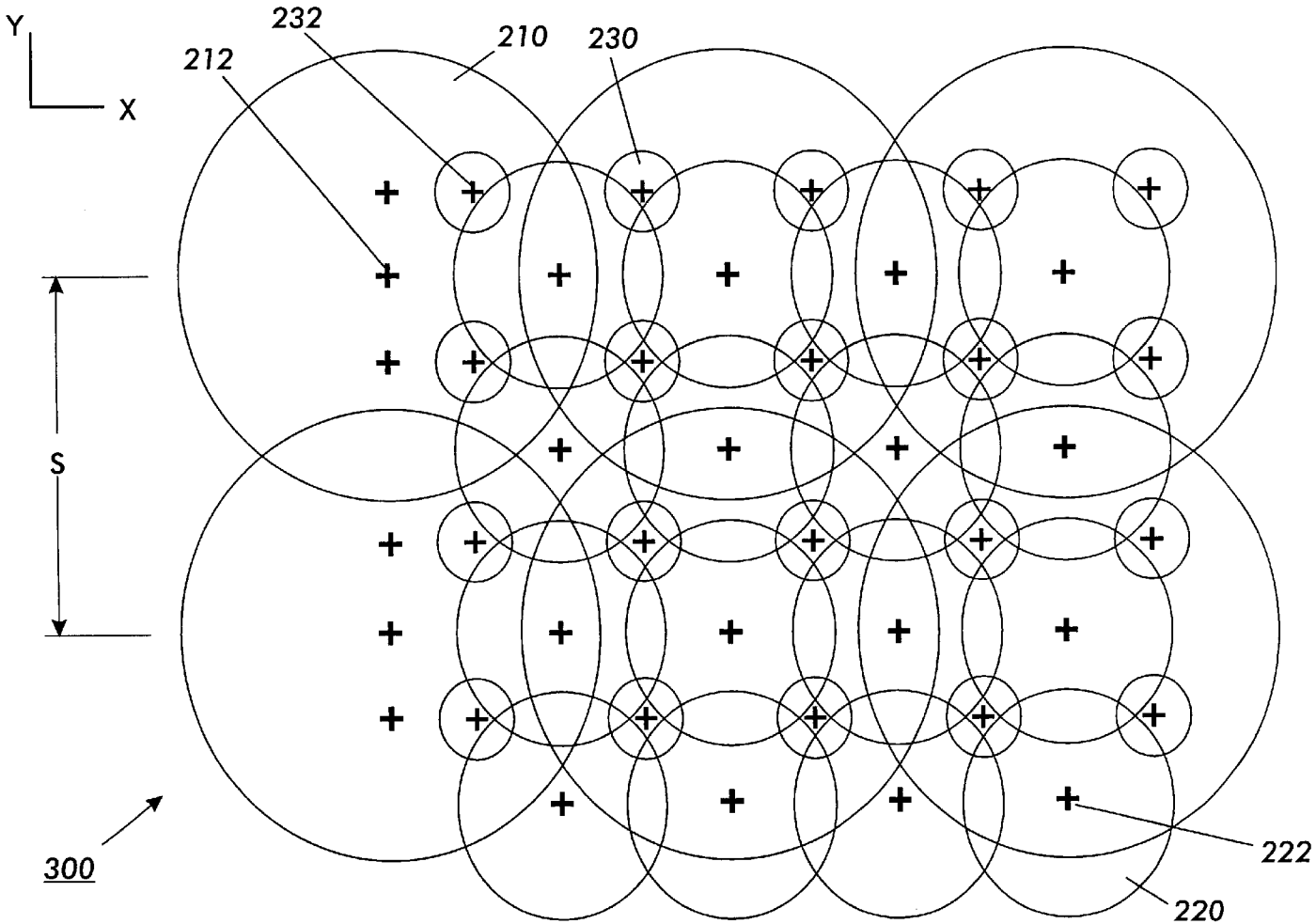
FIG. 5 is a second exemplary embodiment of a fluid ejection pattern according to this invention.

FIG. 5 shows a second exemplary pattern 300 according to this invention. The pattern 300 is similar to the pattern 200 shown in FIG. 4. However, in this second exemplary embodiment of the pattern 300, the mid-sized and small spots 220 and 230 have been offset by S/4 in the Y, or paper advance, direction relative to the mid-sized and small spots 220 and 230 of the first printing pattern 200 shown in FIG. 4. Furthermore, it should be appreciated that, in the second printing pattern shown in FIG. 5, some of the mid-sized spots 220 are aligned with the large spots 210 in the Y, or process, direction. Furthermore, it should also be appreciated that the some of the mid-sized spots 220, rather than some of the small spots 230, are placed within the void occurring between four adjacent large spots 210. As a result, the mid-sized spots 220 can be reduced in size for better fluid economy and less overlap, so that more non-identical density levels are possible.

It should be appreciated that, by offsetting the grids of the differently-sized spots, more individual density levels are possible. In constructing ejection patterns for different density levels, the lightest density levels can be made up of one or more of the small spots 230. In FIGS. 4 and 5, the small spots 230 do not intersect with one another. In the specific exemplary embodiments of the first and second embodiments of the first and second patterns 200 and 300 shown in FIGS. 4 and 5, the spot diameters are approximately 1.2S, 0.6S and 0.2S, for the large, mid-sized and small spots 210, 220 and 230, respectively. However many other combinations of spot diameters can be used. To create the mid-range density levels, one or more of the mid-sized spots 220 can be used in combination with one or more of the small spots 230. For the densest levels, the large spots 210 are also used.

Figure 6:
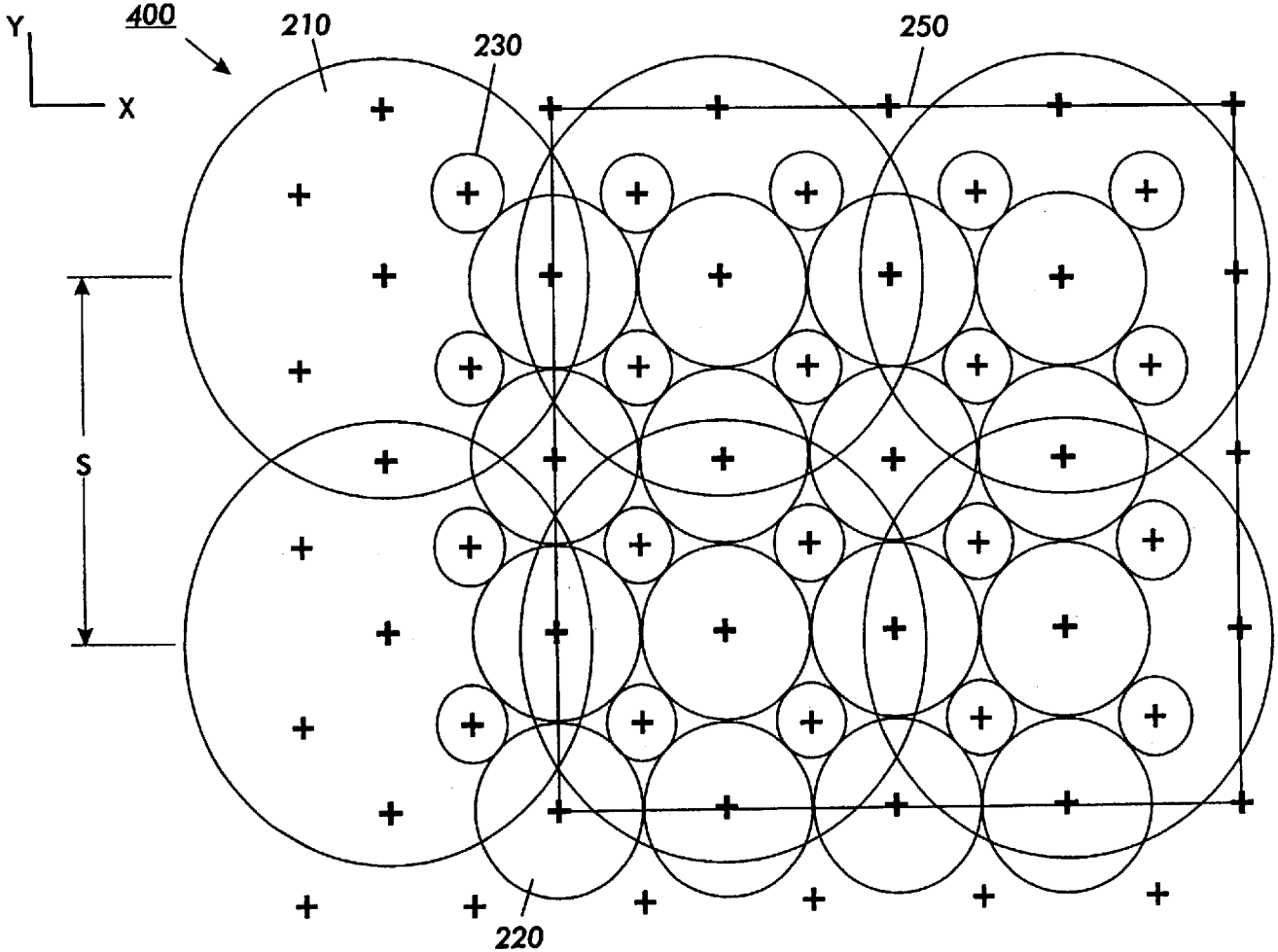
FIG. 6 is a third exemplary embodiment of a third ejection according to this invention.

FIG. 6 shows a third exemplary pattern 400 according to this invention. The relative location of large, mid-sized and small spots in pattern 400 is similar to the pattern 300 shown in FIG. 5. However, in this exemplary embodiment, the mid-sized spots 220 have diameters of approximately 0.5S. The small spots 230 have diameters of approximately 0.2S. As a result, the mid-sized spots 220 do not overlap each other and do not overlap the small spots 230. The small spots 230 are also diagonally offset from the mid-sized spots 220. It also should be appreciated that the small and mid-sized spots do not overlap, as the sum of their diameters is less than 0.707S, that is half the square root of 2 times the grid spacing S of the large spots. Thus, a smoothly varying increase in the coverage or optical density, and thus a smoothly-varying increase in the density levels of a cell 250 is available as more of the mid-sized and/or small spots 220 and/or 230 are printed.

In the second and third patterns shown in FIGS. 5 and 6, the darkest density level pattern which uses the least ink is the one in which all of the large spots 210 are used, with the mid-sized spots 220 located at the voids 214 between the large spots 210. In various exemplary embodiments of the third printing pattern, as shown in FIG. 6, if S corresponds to 300 spi, that is 84.67 $\mu$m, the large spots 220 have a diameter of 102 $\mu$m, the mid-sized spots 220 have a diameter of 42 $\mu$m and the small spots 230 having a diameter of 17 $\mu$m. However, it should be appreciated that many other combinations of spot size diameters for the large, mid-sized and small spots 210, 220 and 230 are possible.

Figure 7:
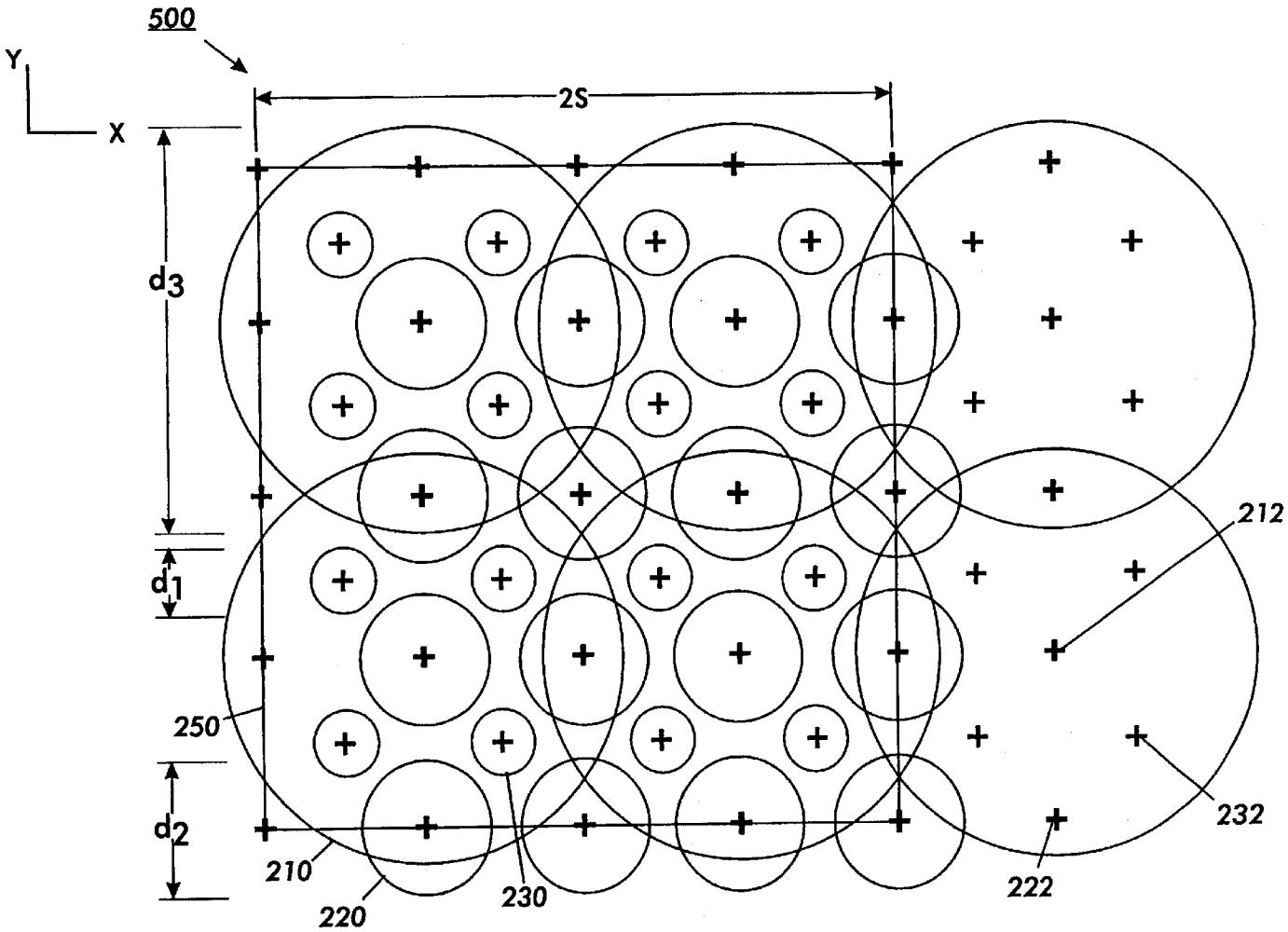
FIG. 7 is a fourth exemplary embodiment of a third ejection pattern according to this invention.

FIG. 7 shows a fourth exemplary pattern 500 according to this invention. The pattern 500 is similar to the pattern 400 shown in FIG. 6. However, in this exemplary embodiment, the small, mid-sized and large spots 230, 220 and 210 have diameters of $d_1$, $d_2$ and $d_3$, respectively. In various exemplary embodiments, the large spots 210 may be smaller than the required space filling diameter of $\sqrt{2}$ S, that is $d_3<1.414S$. Furthermore, some of the mid-sized spots 220 are at the voids between four neighboring large spots 210. Thus, a smoothly-varying increase in the density levels of a cell 250 is available, as more of the mid-sized and/or small spots 220 and/or 230 are printed.

The cell 250 has an area of $4S^2$, and holds four of the large spots 210. It should be appreciated that, if only the large spots 210 were used to create the different density level patterns, only six non-equivalent density levels, corresponding to white, and to one spot, two adjacent spots which are partially overlapping, two diagonally adjacent spots which do not overlap, three spots, or all four large spots 210 in the cell 250, could be obtained in the cell 250. Furthermore, it should be appreciated that 16 small spots 230 and 16 mid-sized spots 220 fit within the cell 250. It should also be appreciated that, even though some of the medium spots fall partially outside the cell 250 because of the offsetting grids, the sum of the area of the mid-sized spots 220 within the cell 250 is equivalent to the area of 16 complete mid-sized spots 220.

The area of a cell 250 with side 2S is $4S^2$. As a result, to have 64 different density levels, each density levels should differ by $4S^2/64$ or $S^2/16$, from the adjacent density levels. Thus, the lightest tone should have an area of approximately $4S^2/64$ or $S^2/16$. Since the area of the small spot 230 is $\pi d_1^2/4$ for a small spot having a diameter d, the small spot diameter $d_1$ should be $d_1=S/(2\sqrt{\pi})$, or approximately 0.282S.

In various exemplary embodiments, to smoothly increase the density of the cell 250, the mid-sized spot 220 should have a mid-sized spot diameter $d_2$ which will result in approximately twice the area of the small spot 230. Thus, if the small spot diameter $d_1$ is $S/2\sqrt{\pi}$, the mid-sized spot diameter $d_2=S/(\sqrt{2}\sqrt{\pi})$, or approximately 0.399S, so that the area of the mid-sized spot 220 is $S_2/8$.

The lowest density level, called level 0 here, has no spots printed. The next 48 density levels may be formed simply by sequentially filling the cell 250 with the 16 small spots 230 and the 16 mid-sized spots 220. The lowest non-white area coverage of $S^2/16$ is created by printing a single small spot 230 in the cell 250. The next lowest coverage of $S^2/8$ is made by printing either two small spots 230, since the small spots do not overlap, or a single mid-sized spot 220 in the cell 250.

Figure 8:
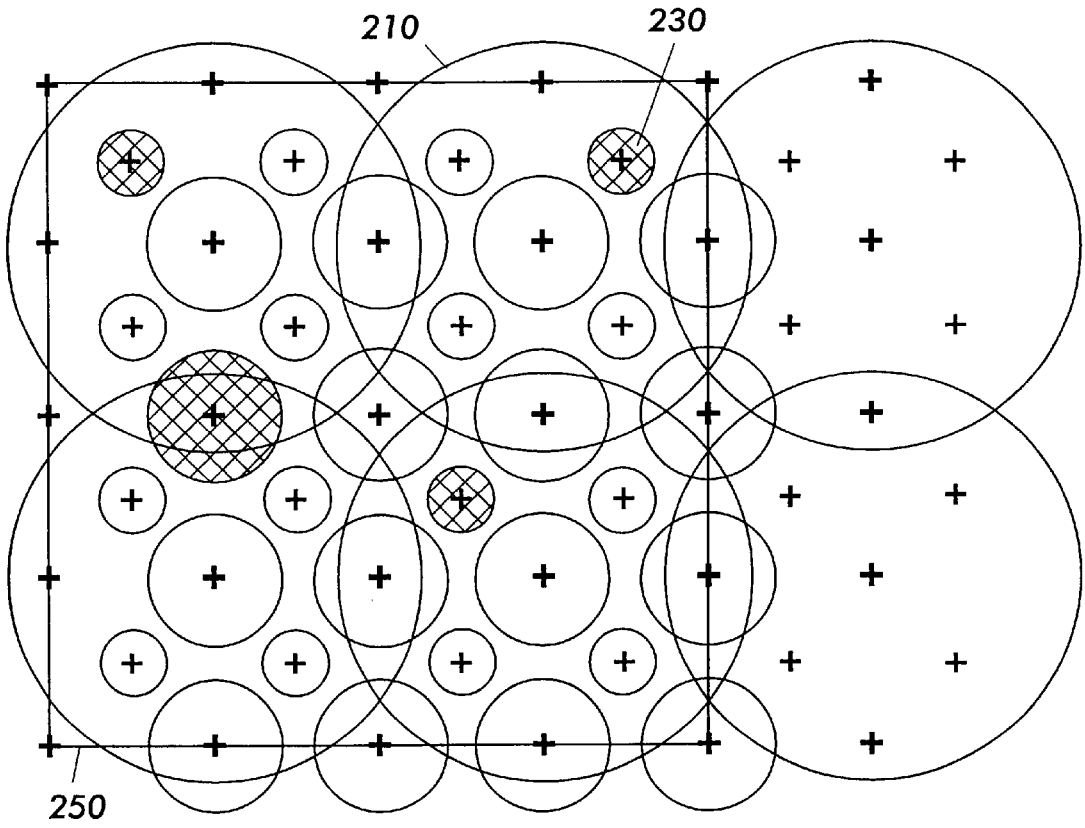
FIGS. 8–13 illustrate various fractional areas covered using various exemplary spot patterns to create various variable density levels according to this invention.
Figure 9:
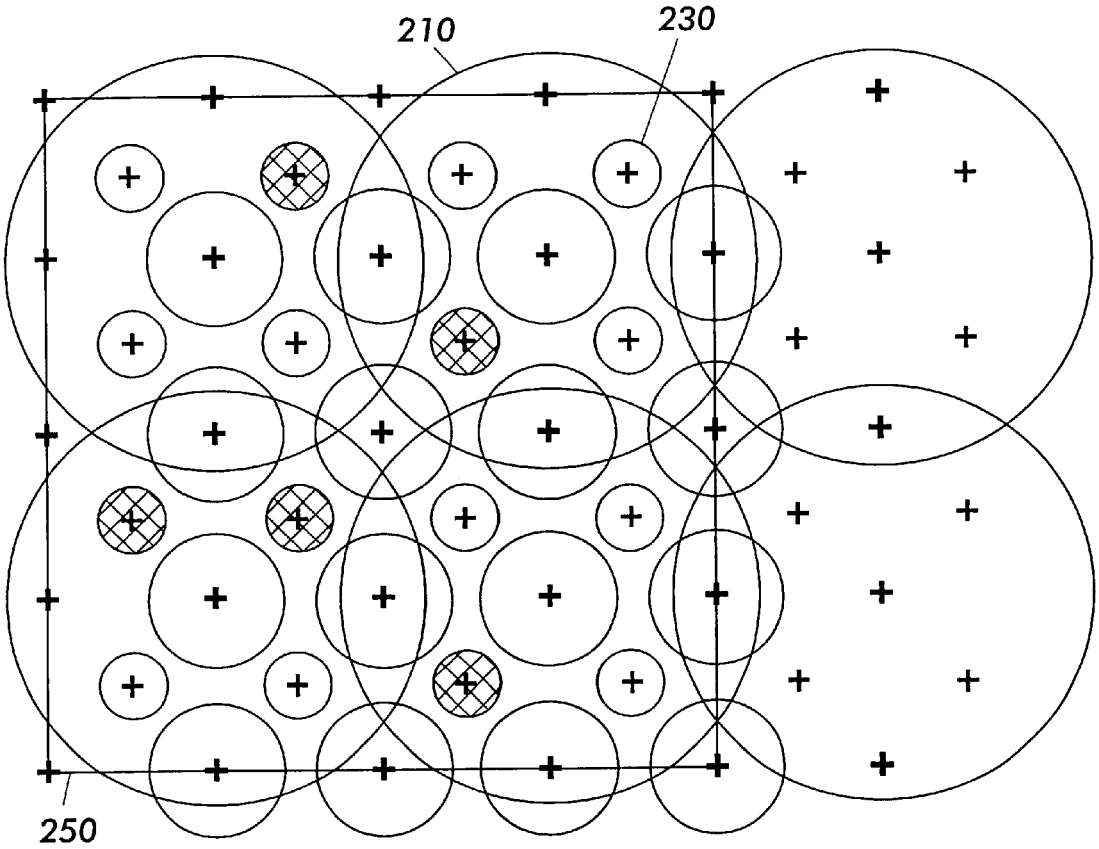

The density of the cell 250 continues to increase in increments of $S^2/16$ as additional single small spots 230 are printed in the cell 250, with the option of printing an additional single mid-sized spot 220 in the cell 250 in place of any two of the small spots 230. FIGS. 8 and 9 show a cell with a level 5 density, for example. FIG. 8 uses three small spots 230 and a single mid-sized spot 220 to obtain a $5S^2/16$ density level. However, as shown in FIG. 9, five small spots can alternatively be used and at different locations in order to obtain the level 5 density.

Figure 10:
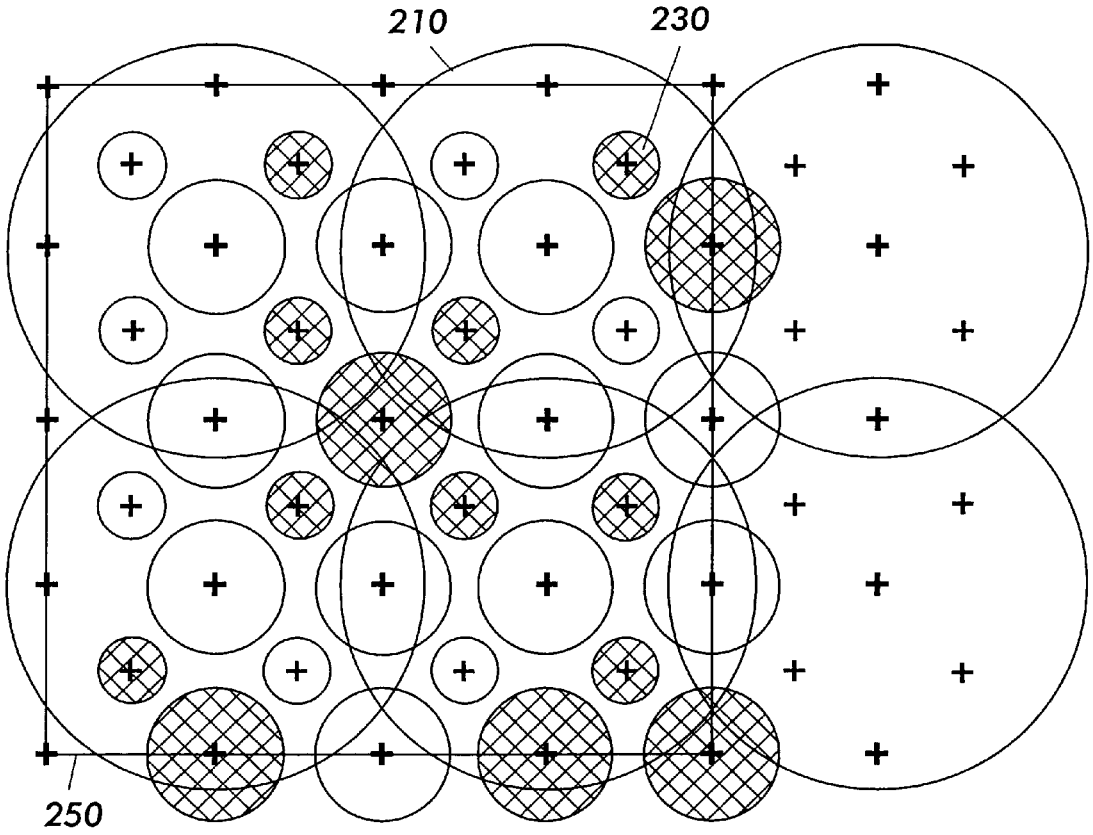
Figure 11:
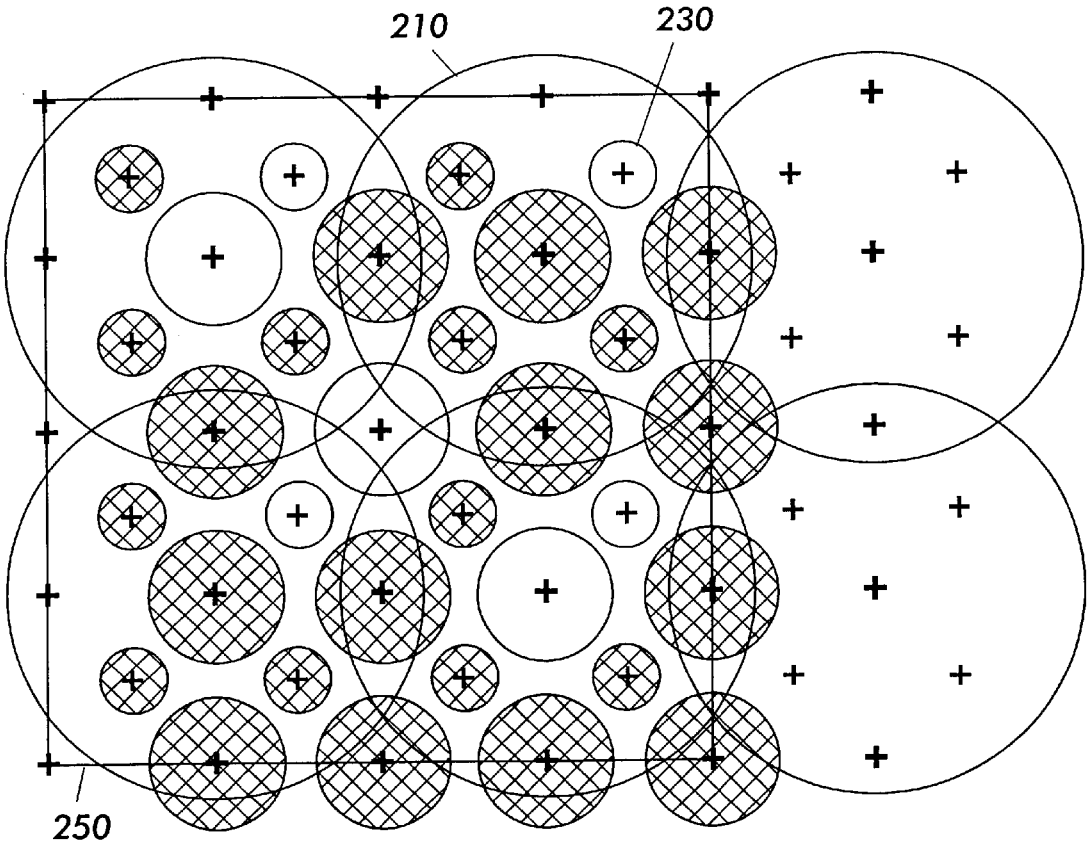

A cell having a level 16 density has an area coverage of $S^2$ and can be obtained by printing all of the 16 small spots 230 or any eight of the mid-sized spots 220, or any other combination of small and mid-sized spots 230 and 220 that have a total area of $S^2$. FIG. 10 is an exemplary embodiment of a cell 250 having a level 19 density. A cell 250 having a level 32 density has an area coverage of $2S^2$ and can be obtained by printing all of the 16 mid-sized spots 220 or any eight of the mid-sized spots 220 plus all 16 small spots 230 or any of the combination of small and mid-sized spots 230 and 220 that have a total area of $2S^2$. FIG. 11 is an exemplary embodiment of a cell 250 having a level 36 density. A cell 250 having a level 48 density has an area coverage of $3S^2$ and can be obtained by printing all of the 16 mid-sized spots 220 plus all 16 of the small spots 250.

Since the mid-sized and small spots 220 and 230 do not overlap, the mid-sized and small spots 220 and 230 are completely independent of each other. Thus, density levels comprising a white cell 250 and cells 250 having level 1–48 densities, can be obtained in area coverage increments of $S^2/16$ by merely adding additional printed spots 220 and/or 230 to the cell 250. As a percentage of the area of cell 250 ($4S^2$), the area coverage increases linearly for these first 48 non-white levels by 1.5625% per level.

To further increase the area coverage between $3S^2$ and $4S^2$, the large spots 210 must be used. In various exemplary embodiments, the large spots 210 have a diameter $d_3$ of 1.2S, and thus have an area of $\pi d_3^2/4$, or $1.13S^2$. The following description of obtaining a cell 250 level 49–63 densities will be discussed in view of the cell 250 shown in the exemplary embodiment of the fourth pattern according to this invention shown in FIG. 7. It should be appreciated that the large spots 210 overlap not only some of the mid-sized and small spots 220 and 230, but also partially overlap adjacent large spots (though not if diagonally adjacent). Additionally, portions of the large spots 210 extend outside of the cells 250, while, at the same time, portions of large spots 210 in adjacent cells extend into the cell 250 shown in FIG. 7. Thus, determining the combination of large spots 210, mid-sized spots 220 and small spots 230 that need to be generated to obtain a particular level 49–63 densities is a complex function that must take into account these various overlaps and the actual areas of the spots 210 in the cell 250. Because of spot overlaps, the area coverage increment from level 49–63 densities is not linear.

In the following discussion of the specific patterns that are usable to obtain cells 250 having level 49–63 densities, the following description assumes that the large spot 210 in the upper left corner of the cell 250 is used for level 49–52 densities and that the nonoverlapping large spots 210 in the upper left and lower right-hand corners are used to obtain cells 250 having level 53–57 densities. However, it should be appreciated that any one of the large spots 210 in the cell 250 can be used as the initial large spot. In this case, the following description identifying which mid-sized and/or small spots 220 and 230 are used will be rotated accordingly.

Figure 12:
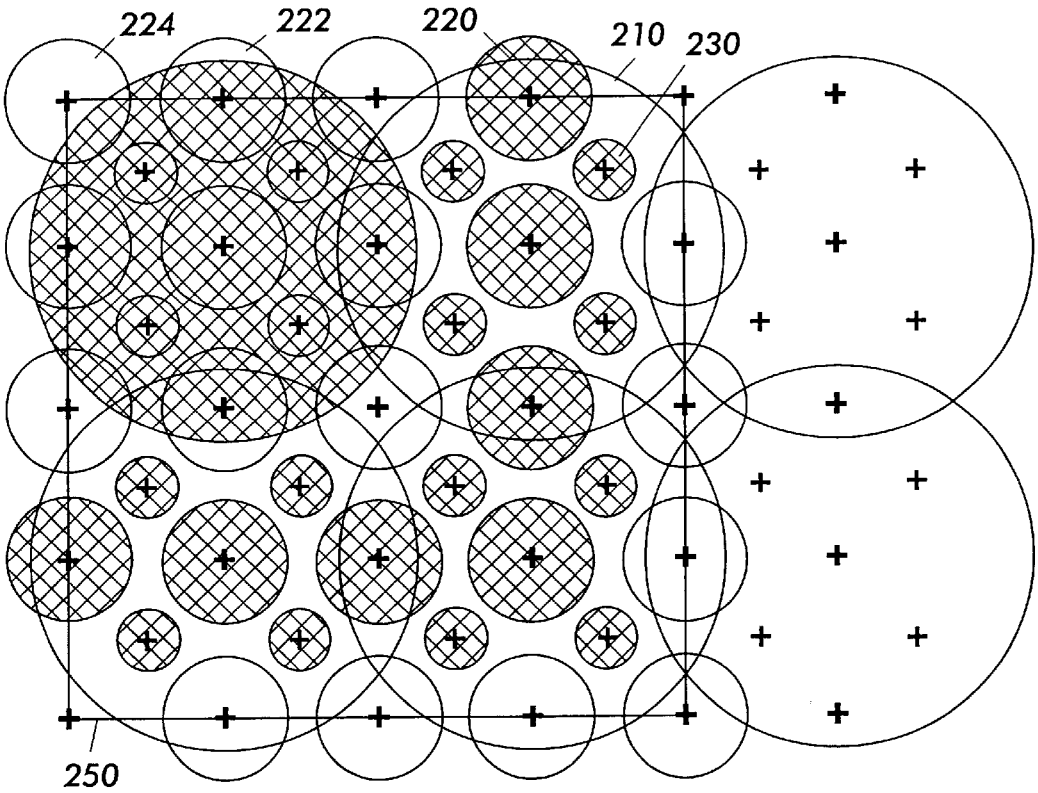
Figure 13:
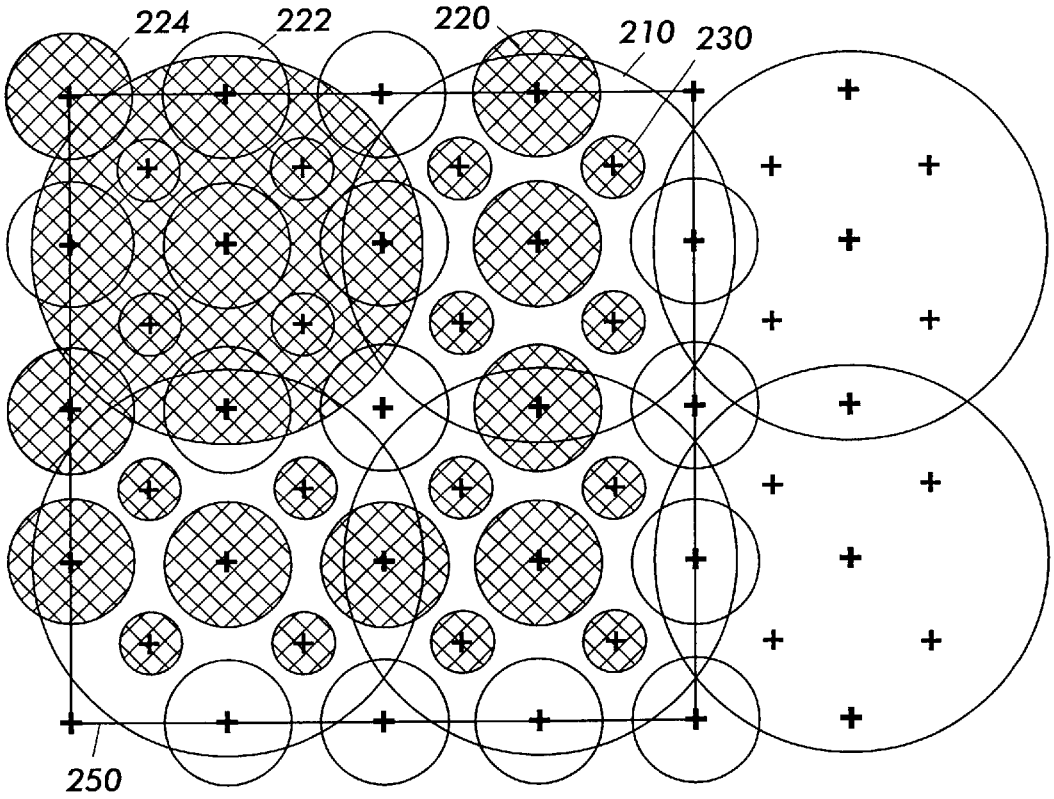

FIGS. 12 and 13 show one exemplary unsatisfactory and one exemplary satisfactory embodiment respectively of a cell having a level 49 density. As shown in FIG. 12, the large spot 210 in the lower right hand corner of the cell 250 is used. The small and mid-sized spots 220 and 230 of cell 250 are then used. In various exemplary embodiments, the mid-sized and small spots 220 and 230 which are completely independent of each other are first used, as shown in FIG. 12. However, only seven mid-sized spots 220 and 12 small spots are available that are completely independent the large spot 210. Thus, the area coverage would only be $1*1.13\ S^2$ for the large spot 210, $7*S^2/8$ for the seven mid-sized spots 220 and $12*S^2/16$ for the twelve small spots 230 for a total area coverage of $2.755S^2$. As should be appreciated, the total area coverage would be less than the level 48 density, which is not satisfactory, since each level needs to have a higher tone density than the previous level.

In order to further increase the total area coverage, some of the overlapping mid-sized spots 220 will have to be used. As shown in FIG. 12, there are four overlapping mid-sized spots 220 whose centers are displaced from the large spot 210 by S/2 in one of the X or Y, or scan or paper advance directions. These four overlapping spots are referred to as the "adjacent overlap" (or A Ov) spots 222. The area coverage of each adjacent overlap spot 222 independent of, or not already overlapped by, the large spot 210 is approximately $0.028S^2$.

Also shown in FIG. 12 are four overlapping mid-sized spots 220 whose centers are diagonally displaced from the large spot 210. These four overlapping spots are referred to as the "diagonal overlap" (or D Ov) spots 224. The area coverage of each diagonal spot 224 independent, or not already overlapped by, of the large spot 210 is $0.105S^2$.

In various exemplary embodiments, in order to have a level 49 density, three diagonal overlap spots 224 are added to the pattern shown in FIG. 12, as shown in FIG. 13. Thus, a total area coverage of approximately $S^2/16$ greater than the level 48 density is achieved. However, it should be appreciated that any combination of adjacent spots 222 and diagonal spots 224 that add a total coverage area of approximately $S^2/16$ can be used.

For cells having level 49–63 densities the following table can be used. However, it should be appreciated that any combination of spot patterns can be used, if at combination incrementally increases the spot coverage by approximately $S^2/16$.

TABLE 1

| Level | Large Spots | Mid-Sized Spots | Small Spots | Area Coverage/$S^2$ | Percent covered |
|---|---|---|---|---|---|
| 49 | 1 | 7 + 3 D Ov | 12 | 3.070 | 76.8 |
| 50 | 1 | 7 + 3 D Ov + 2 A Ov | 12 | 3.126 | 78.2 |
| 51 | 1 | 7 + 3 D Ov + 4 A Ov | 12 | 3.182 | 79.6 |
| 52 | 1 | 7 + 4 D Ov + 4 A Ov | 12 | 3.297 | 82.4 |
| 53 | 2 | 2 + 1 D Ov + 8 A Ov | 8 | 3.319 | 83.0 |
| 54 | 2 | 2 + 2 D Ov + 7 A Ov | 8 | 3.376 | 84.4 |
| 55 | 2 | 2 + 3 D Ov + 6 A Ov | 8 | 3.433 | 85.8 |
| 56 | 2 | 2 + 4 D Ov + 5 A Ov | 8 | 3.490 | 87.3 |
| 57 | 2 | 2 + 4 D Ov + 8 A Ov | 8 | 3.574 | 89.4 |
| 58 | 3 | 1 + 4 D Ov + 4 A Ov | 4 | 3.627 | 90.7 |
| 59 | 4 | 0 | 0 | 3.820 | 95.5 |
| 60 | 4 | 1 | 0 | 3.865 | 96.6 |
| 61 | 4 | 2 | 0 | 3.910 | 97.8 |
| 62 | 4 | 3 | 0 | 3.955 | 98.9 |
| 63 | 4 | 4 | 0 | 4.000 | 100.0 |

Filling Scheme, Area Coverage and Normalized Area Coverage for Levels 49–63

For cells having level 53–57 densities, one of the two pairs of two diagonally non-overlapping large spots 210 is used. Thus, the overlap between adjacent cells 250 is not counted. The two diagonal large spots 210 also do not overlap with the large spots in adjacent cells. To obtain a cell 250 having a level 58 density, any three of the large spots 210 are used. In this case, the overlap between the large spots 210 in the adjacent cells 250 is considered. To obtain a cell 250 having level 59–63 densities, four large spots 230 are used, along with successively filling the voids 214 with the mid-sized spots 220.

Figure 14:
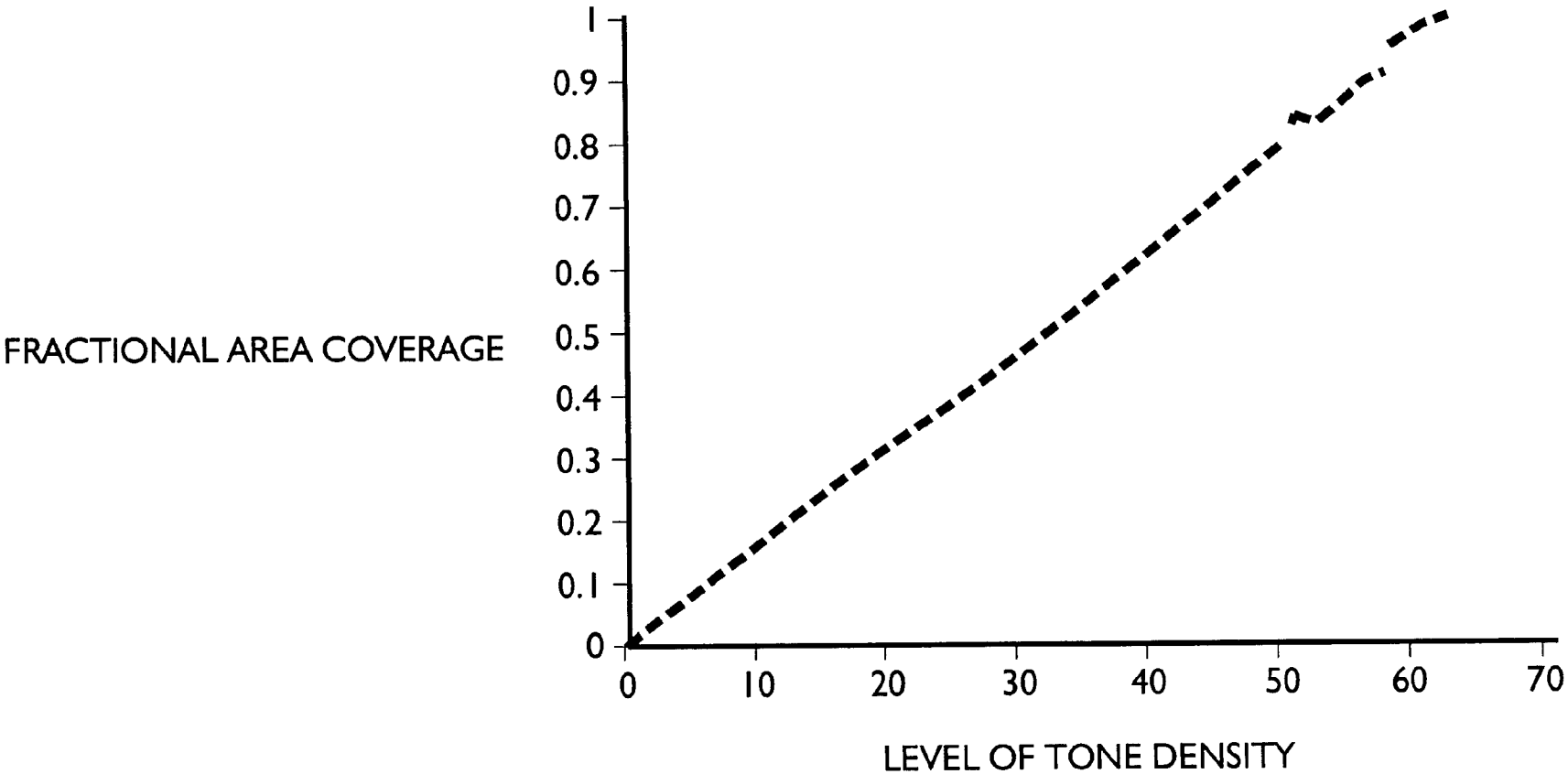
FIG. 14 illustrates various fractional areas covered using the spot patterns created by firing selected ones of the differently-sized nozzles to create variable density levels according to this invention.

FIG. 14 is a graph illustrating the fractional increase in ink coverage per tone density values. As shown in FIG. 14, for tone density values between 1 and 48, the fractional area coverage steadily increases in increments of 1.5625%.

Figure 15:
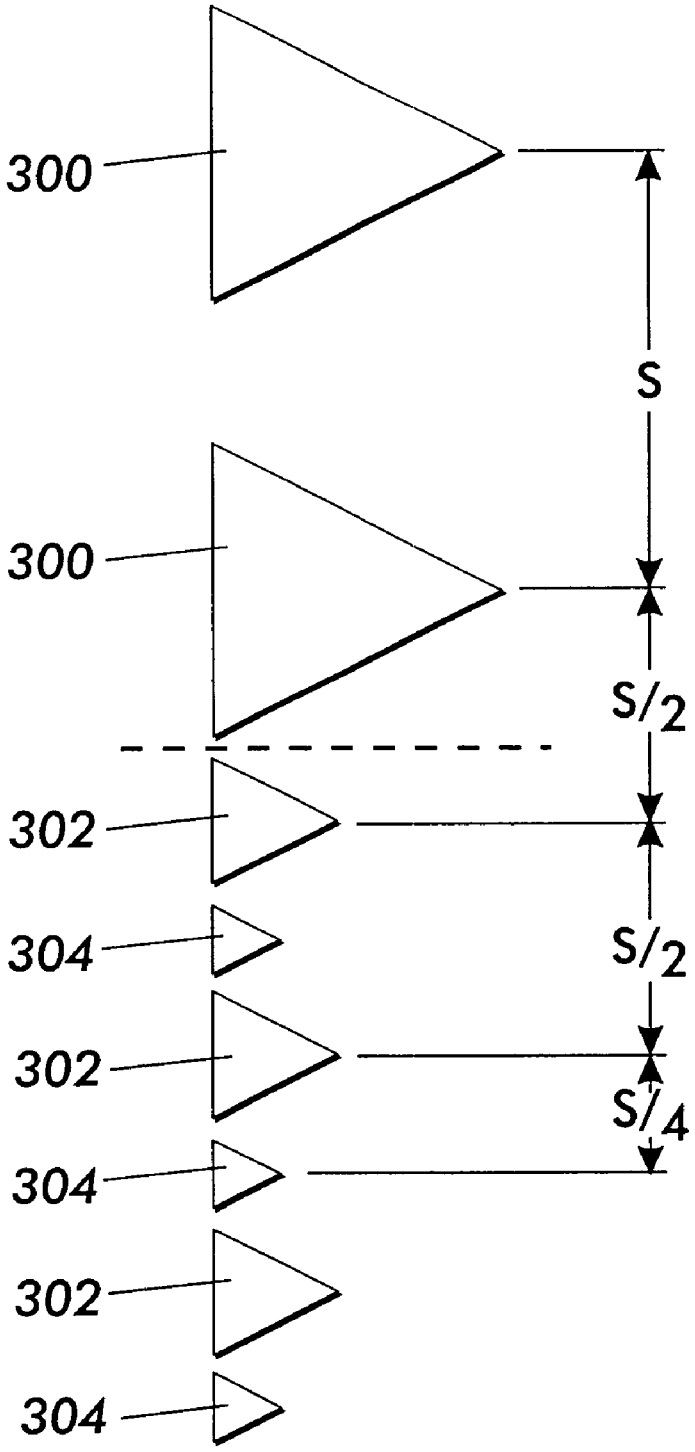
FIG. 15 illustrates a nozzle architecture capable of printing the array of spots shown in FIGS. 4–7.

FIG. 15 illustrates a first exemplary embodiment of a nozzle architecture according to this invention. The nozzle architecture shown in FIG. 15 includes a plurality of nozzles capable of generating the pattern 200 shown in FIG. 4.

In various exemplary embodiments, the nozzles may be in a single fluid ejector head 170. In various other exemplary embodiments, the nozzles can be provided in two separate fluid ejector heads 170 separated as shown by the dotted line of FIG. 15. As shown in FIG. 15, the large nozzles 300 are located in a first fluid ejector head 170, while the small and medium nozzles 302 and 304 are located in a second fluid ejector head 170.

In various exemplary embodiments, the pitch between the individual large nozzles 300 is S. The pitch between the mid-sized nozzles 302 is S/2 and the pitch between the small nozzles 304 is S/2. It should be appreciated that the pitch between the adjacent mid-sized nozzles 302 and small nozzles is S/4. Also in various exemplary embodiments, the pitch between the large nozzle 300 of the first fluid ejector head and the adjacent mid-sized nozzle 302 of the second printhead is n S/2, where n is an odd integer.

In order to print the pattern 300–500 shown in FIGS. 5–7, it should also be appreciated that the position of the mid-sized and small nozzles 302 and 304 is reversed. Thus, the pitch between the large nozzle 300 of the first printhead and the adjacent small nozzle 304 of the second printhead is n S/2, where n is an odd integer.

Figure 16:
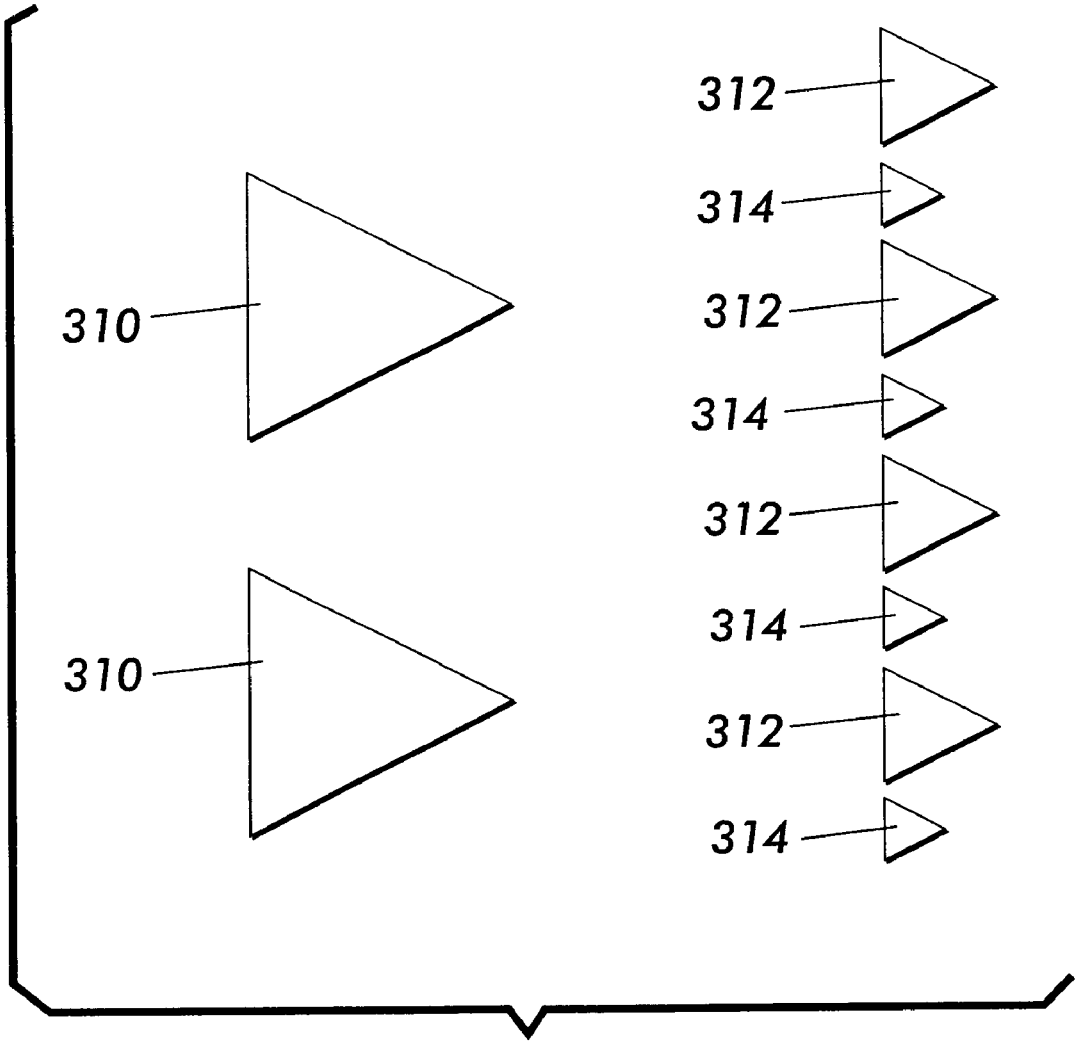
FIG. 16 illustrates a second fluid ejector head nozzle architecture capable of printing an array of spots shown in FIGS. 4–7.

FIG. 16 shows a second exemplary embodiment of a nozzle architecture according to this invention for each plurality of nozzles capable of generating the pattern 200 shown in FIG. 4. In this second exemplary embodiment, the large nozzles 310 are located in a first ejector head 170, while the mid-sized and small nozzles 312 and 314 are located in a second ejector head 170.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A method for forming variable density patterns, comprising:

producing a plurality of large spots;

producing a plurality of mid-sized spots;

producing a plurality of small spots, wherein the pluralities of the small, mid-sized and large spots are produced to provide one of a plurality of different density levels; and arranging the differently-sized spots such that the plurality of large sized spots is on a square grid of spacing $S_1$, while at least one of the pluralities of smaller sized spots is on a square grid of spacing $S_2$ (where $S_2<S_1$) which is offset from the grid of large spots.

2. The method of claim 1, wherein the area of two small spots is approximately the same as the area of one mid-sized spot.

3. The method of claim 1, wherein the centers of the plurality of large spots are spaced at a distance S.

4. The method of claim 3, wherein the centers of the plurality of mid-sized spots are spaced at a distance S/2 with some of the centers of the plurality of mid-sized spots aligned with the centers of the plurality of large spots.

5. The method of claim 4, wherein the centers of the plurality of small spots are spaced at a distance S/2 and are diagonally offset relative to the plurality of mid-sized spots by S/2.

6. The method of claim 5, wherein the plurality of mid-sized spots have a diameter of approximately 0.5S and the plurality of small spots have a diameter of approximately 0.2S.

7. The method of claim 1, wherein at least one mid-sized spot from the plurality of mid-sized spots is placed within the void occurring between four adjacent large spots from the plurality of large spots.

8. The method of claim 1, wherein the tone density cell has an area of $4S^2$.

9. The method of claim 8, wherein each of the plurality of large spots has an area of approximately $S^2$, each of the plurality of mid-sized spots has an area of approximately $S^2/8$, and each of the plurality of small spots has an area of approximately $S^2/16$.

10. The method of claim 9, wherein 64 levels of gray tone densities are available.

11. The method of claim 10, wherein the area covered by spots for each level of tone density is increased by approximately $S^2/16$.

12. A printhead for ejecting droplets of fluid to form spots on a printing substrate, comprising:

a first set of drop ejectors forming a plurality of large spots;

a second set of drop ejectors forming a plurality of mid-sized spots;

a third set of drop ejectors forming a plurality of small spots wherein the pluralities of the small, mid-sized and large spots are produced to provide one of a plurality of different density levels; and a controller for arranging the differently-sized spots such that the plurality of large sized spots is on a square grid of spacing $S_1$, while at least one of the pluralities of smaller sized spots is on a square grid of spacing $S_2$ (where $S_2<S_1$) which is offset from the grid of large spots.

13. The printhead of claim 12, wherein the area of the mid-sized spot is approximately the same as of the area of two small spots.

14. The printhead of claim 12, wherein the centers of the plurality of large spots are spaced at a distance S.

15. The printhead of claim 12, wherein the centers of the plurality of mid-sized spots are spaced at a distance S/2 with some of the centers of the plurality of mid-sized spots aligned with the centers of the plurality of large spots.

16. The printhead of claim 15, wherein the centers of the plurality of small spots are spaced at a distance S/2 and are diagonally offset relative to the plurality of mid-sized spots by S/2 .

17. The printhead of claim 16, wherein the plurality of mid-sized spots have a diameter of approximately 0.5S and the plurality of small spots have a diameter of approximately 0.2S.

18. The printhead of claim 12, wherein at least one mid-sized spot from the plurality of mid-sized spots is placed within the void occurring between four adjacent large spots from the plurality of large spots.

19. The printhead of claim 12, wherein the tone density cell has an area of $4S^2$.

20. The printhead of claim 19, wherein each of the plurality of large spots has an area of approximately $S^2$, each of the plurality of mid-sized spots has an area of approximately $S^2/8$, and each of the plurality of small spots has an area of approximately $S^2/16$.

21. The printhead of claim 20, wherein 64 levels of gray tone densities are available.

22. The printhead of claim 21, wherein the area covered by spots for each level of tone density is increased by approximately $S^2/16$.

* * * * *